US005704317A

United States Patent [19]

Barth

[11] Patent Number: 5,704,317

[45] Date of Patent: Jan. 6, 1998

[54] METHOD FOR OPERATING A HYDRAULICALLY CONTROLLED/ REGULATED CAMSHAFT ADJUSTER FOR INTERNAL COMBUSTION ENGINES

[75] Inventor: Roland Barth, Munich, Germany

[73] Assignee: Bayerische Motoren Werke Aktiengesellschaft, Munich, Germany

[21] Appl. No.: 695,348

[22] Filed: Aug. 9, 1996

[30] Foreign Application Priority Data

Aug. 9, 1995 [DE] Germany ..... 195 29 277.4

[51] Int. Cl.[6] ..... F01L 1/344

[52] U.S. Cl. ..... 123/90.17; 123/90.31

[58] Field of Search ..... 123/90.12, 90.13, 123/90.15, 90.16, 90.17, 90.31

[56] References Cited

U.S. PATENT DOCUMENTS 4,787,345 11/1988 Thoma ..... 123/90.17
5,127,375 7/1992 Bowman et al. ..... 123/90.12
5,243,935 9/1993 Kano et al. ..... 123/90.17
5,509,383 4/1996 Kahrs et al. ..... 123/90.17

FOREIGN PATENT DOCUMENTS 0 245 791 10/1990 European Pat. Off. .
43 24 987 2/1995 Germany .

*Primary Examiner*—Weilun Lo
*Attorney, Agent, or Firm*—Evenson, McKeown, Edwards & Lenahan, P.L.L.C.

[57] ABSTRACT

In a method for operating a hydraulically controlled/ regulated camshaft adjuster for internal combustion engines, in which a mechanical adjusting device designed to retard the camshaft is controlled by a piston that is hydraulically chargeable on at least one side, to which piston a pressure medium from a hydraulic circuit with a separately driven pump is supplied to an accumulator and to a valve controlled as a function of the operating point, in order to reduce harmful exhaust components when the engine starts, when the engine starts, pressure medium is supplied to the piston from an essentially full accumulator as a function of a start signal under valve control in order to advance the camshaft using the adjusting device.

4 Claims, 1 Drawing Sheet

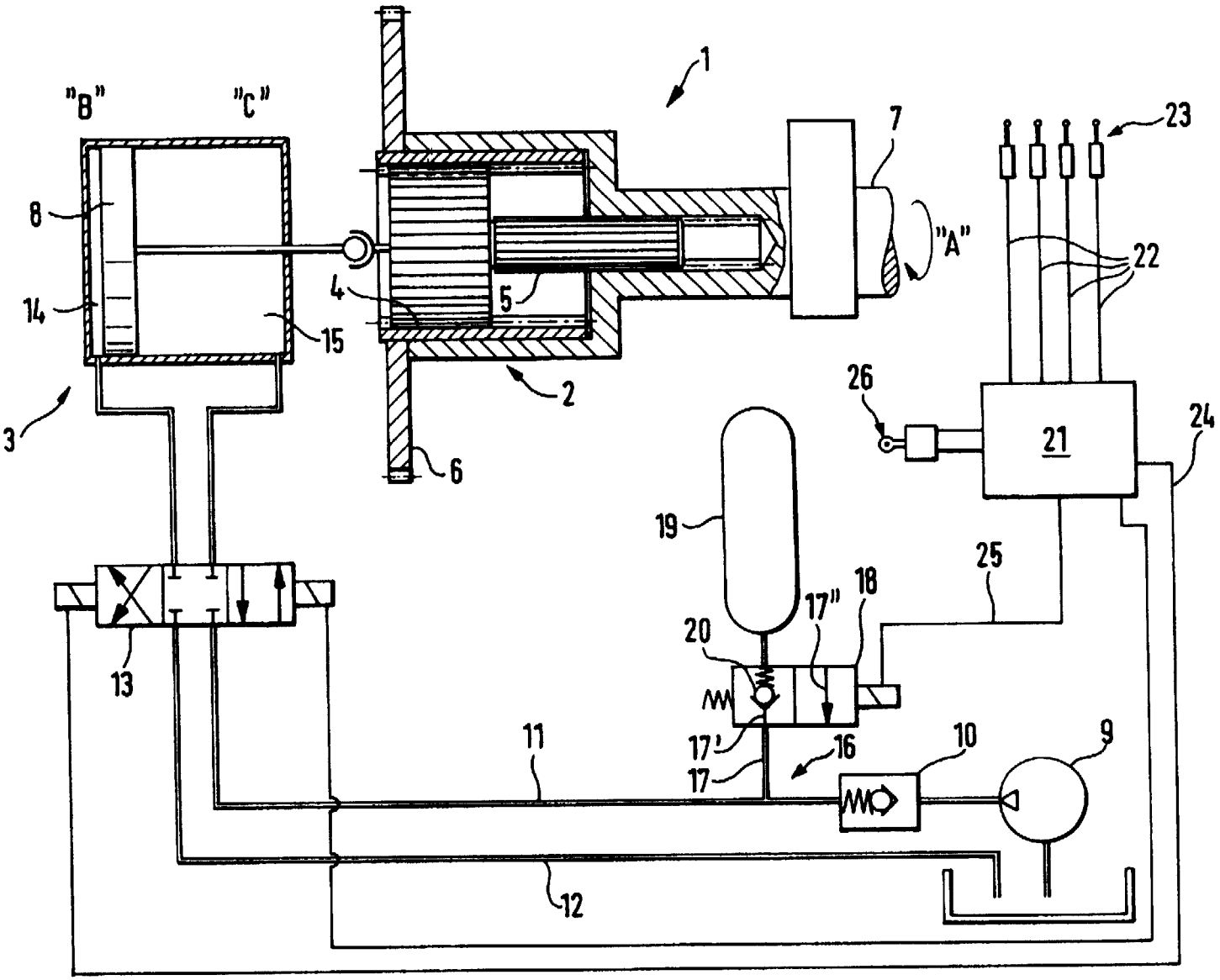
"A"
"B"
"C"
1
2
3
4
5
6
7
8
9
10
11
12
13
14
15
16
17
17'
17"
18
19
20
21
22
23
24
25
26

METHOD FOR OPERATING A HYDRAULICALLY CONTROLLED/ REGULATED CAMSHAFT ADJUSTER FOR INTERNAL COMBUSTION ENGINES

BACKGROUND AND SUMMARY OF THE INVENTION

The invention relates to a method for operating a hydraulically controlled/regulated camshaft adjuster for internal combustion engines in which a mechanical adjuster, set for the retarded position of the camshaft, is controlled by a piston, hydraulically chargeable at least unilaterally, to which a pressure medium is supplied from a hydraulic circuit with a separately driven pump, an accumulator, and a valve controlled as a function of the operating point.

A camshaft adjuster operated in accordance with the method described above is known from European Patent document EP-B-0245791, in which the mechanical adjuster, by a suitable choice of the direction of a helical gearing relative to the rotational direction of the camshaft, is so designed that if the control/regulating hydraulics should fail, the camshaft encounters a stop in the retarded position. This design, intended to ensure engine operation, depending on the choice of the valve lift curves and the spread between the inlet and exhaust cams, has a relatively wide valve overlap. This results in increased emission of harmful components in the exhaust, especially during a cold engine start.

The requirement for a rapid advance in the setting each time the engine starts, within one second for example, cannot be met with a motor-operated pump in the hydraulic circuit.

The goal of the invention is to improve the above-described operating method for a camshaft adjuster with a simple design in such fashion that a rapid advance in the setting of the camshaft can be achieved as a function of engine starting.

This goal is achieved according to the present invention by a method for operating a hydraulically controlled/ regulated camshaft adjuster for internal combustion engines in which a mechanical adjuster, set for the retarded position of the camshaft, is controlled by a piston, hydraulically chargeable at least unilaterally, to which a pressure medium is supplied from a hydraulic circuit with a separately driven pump, an accumulator, and a valve controlled as a function of the operating point. When the engine starts, the pressure medium is supplied from an essentially full accumulator as a function of a start signal under valve control, to the piston in order to advance the camshaft by way of the adjuster.

With the present invention, using an accumulator which is chargeable from the hydraulic circuit and connectable by a start signal to the hydraulic circuit under valve control, a method for the fastest possible advance setting of the camshaft when starting the engine is achieved in an advantageous manner and with a simple design. With suitable dimensioning of the hydraulic circuit, the pressure rise in the hydraulic circuit when starting the engine can occur essentially in accordance with a step function, so that an advanced setting is advantageously achieved in fractions of a second.

With the method according to the present invention, it is advantageous to deliberately lower the pressure in the hydraulic circuit when shutting-off the engine in order to protect devices connected with the hydraulic circuit.

Other objects, advantages and novel features of the present invention will become apparent from the following detailed description of the invention when considered in conjunction with the accompanying drawings.

BRIEF DESCRIPTION OF THE DRAWING

The sole FIGURE is a schematic diagram of a hydraulic circuit for a camshaft adjuster.

DETAILED DESCRIPTION OF THE DRAWING

A camshaft adjuster 1 of an internal combustion engine, not shown in greater detail, comprises a mechanical adjuster 2 and a hydraulic actuating device 3. With the hydraulic actuating device 3 inactive, the mechanical adjuster 2 retards a camshaft 7 through the use of its teeth 4 and 5 corresponding to the drive direction indicated by arrow "A" of output gear 6. A piston 8 of the actuating device 3 assumes an end position "B".

The internal combustion engine is also equipped with a lubricating oil pump 9, driven by the engine for example. The pump delivers oil through a check valve 10 into a feed line 11 of the hydraulic actuating device 3. A return line 12 is also associated with the hydraulic actuating device 3. An electromagnetically controlled 4/3-way valve 13 connects lines 11, 12 with control chambers 14, 15 provided on both sides of the piston 8 to advance or retard the camshaft 7 as a function of the operating point.

An accumulator 19 is connected to a hydraulic circuit 16 upstream of the check valve 10 through a line 17 and a 2/2-way valve 18. The hydraulic circuit is essentially composed of the pump 9, the feed line 11, the return line 12, and the 4/3-way valve 13. The electromagnetically operable 2/2-way valve 18, connected in series with the accumulator 19, has a seat valve 20 connected in the accumulator feed path 17' that connects with the hydraulic circuit 16 on the pump side. Seat valve 20 serves to retain the pressure medium from the hydraulic circuit 16 in the accumulator 19.

An electronic control unit is indicated by 21. The unit 21 is connected by signal lines 22 with an ignition system 23. Another control line 24 is connected with the electromagnetically operable 4/3-way valve 13 in such fashion that the feed line 11 is connectable with the control chamber 14 of the piston 8 in the retarded position of the camshaft 7. Finally, another signal line 25 runs from the control unit 21 to the electromagnetically operable 2/2-way valve 18, in order to connect the accumulator 19 with the feed line 11 through its outlet path 17".

When the engine, not shown in greater detail, is started by means of an ignition key 26, signals on lines 24 and 25 control multipath valves 13 and 18 in such fashion that the pressure medium is supplied from the essentially full accumulator 19 through the line 11 to the piston 8 in the control chamber 14 to move the camshaft 7 from a retarded to an advanced position, with the pressure buildup at the piston 8 advantageously proceeding in accordance with a step function. With this operating method according to the invention, each time the engine is started, especially when cold, an advantageous advance setting of the camshaft 7 with considerably reduced valve overlap can be obtained to reduce harmful components in the exhaust.

In order to keep the requirement for control current to the multipath valves 13 and 18 low, these valves can be pre-controlled hydraulically for example.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method for operating a hydraulically controlled camshaft adjuster for an internal combustion engine, the method comprising the steps of:

controlling a mechanical adjuster which is set for a retarded position of the camshaft using a piston which is hydraulically chargeable at least unilaterally;

supplying a pressure medium to said piston from a hydraulic circuit having a separately driven pump, an accumulator, and a valve which is controlled as a function of an operating point; and when the engine starts, supplying the pressure medium from an essentially full accumulator as a function of a start signal under valve control to the piston in order to advance the camshaft via the mechanical adjuster.

2. The method according to claim 1, wherein said valve control is performed using an electromagnetically operable 2/2-way valve, connected in series with the accumulator, said valve comprising a seat valve arranged in a pressure medium feedpath, said seat valve communicating with the hydraulic circuit.

3. The method according to claim 1, wherein said valve control uses an electromagnetically operable 2/2-way valve.

4. The method according to claim 2, wherein said valve control uses an electromagnetically operable 2/2-way valve.

* * * * *